United States Patent [19]

Saulietis

[11] Patent Number: 4,945,642

[45] Date of Patent: Aug. 7, 1990

[54] QUILTING TEMPLATE

[76] Inventor: Susan Saulietis, 12617 Harriet La., Santa Fe, Tex. 77510

[21] Appl. No.: 286,179

[22] Filed: Dec. 19, 1988

[51] Int. Cl.[5] ..... A41H 3/00

[52] U.S. Cl. ..... 33/17 R; 33/12; 33/562

[58] Field of Search ..... 33/11, 12, 17 R, 562, 33/563, 565, 483

[56] References Cited

U.S. PATENT DOCUMENTS

| | | | |
|---|---|---|---|
| 317,188 | 5/1885 | Pederson | 33/483 |
| 2,364,529 | 12/1944 | Hill | 33/565 |
| 4,053,986 | 10/1977 | Axelrod | 33/12 |
| 4,057,898 | 11/1977 | Piosky | 33/563 |
| 4,565,006 | 1/1986 | Vouyouka | 33/12 |
| 4,608,939 | 9/1986 | Lampley | 33/562 |

FOREIGN PATENT DOCUMENTS

| | | | |
|---|---|---|---|
| 0000568 | 8/1979 | Japan | 33/12 |

OTHER PUBLICATIONS

Sharlene Jorgenson, "The New Fast and Precise Double Wedding Ring", (2nd Ed. 1988).

*Primary Examiner*—William A. Cuchlinski, Jr.
*Assistant Examiner*—Christopher Fulton
*Attorney, Agent, or Firm*—Rita M. Irani

[57] ABSTRACT

A template for guiding a cutting tool for cutting cloth, paper, or the like is provided having a transparent body, a marked seam allowance, and a handle for accurate repetitive cutting of simple or complex pattern shapes.

3 Claims, 1 Drawing Sheet

QUILTING TEMPLATE

FIELD OF THE INVENTION

The present invention relates to tools for cutting material, and in particular to a template particularly suitable for guiding a cutting tool for repeatedly, accurately cutting material with a blade type cutting tool.

BACKGROUND OF THE INVENTION

It has long been the practice of tailors, seamstresses, quilters, and others who make products from cloth or paper to use a paper pattern for cutting pieces to be joined in the product.

In general, the paper pattern is used to provide a guide for cutting the material with some type of scissors. Paper or other thin, flexible patterns designed for use with scissors can be rendered inaccurate by cutting the pattern during use such that subsequent pieces cut from the same pattern are different from the earlier pieces. The problem of inaccurate cutting and corruption of the pattern is especially troublesome when used with blade type cutting tools rather than scissors.

In addition, using such patterns requires that they be secured in some manner to the material during cutting. The present invention provides a substantially rigid template which can be used repeatedly to accurately and safely cut one or more layers of material using a sharp, blade type cutting tool without the need to trace the template or secure it to the material before cutting.

SUMMARY OF THE INVENTION

The present invention provides a template for accurately cutting simple or complex patterns from flat relatively thin materials such as paper or cloth. The template is formed of a material of sufficient thickness to provide sufficient rigidity to guide a sharp edged cutting tool without being either cut or distorted by the tool. The template is preferably formed of a substantially transparent material for viewing the material to be cut through the template for assuring accurate positioning of the template.

One feature of the invention is the provision of a marking on the template corresponding to the seam line along which the cut material is to be joined with other pattern pieces. In a preferred embodiment, the marking is made by roughening the surface a fixed distance from the cutting edge of the template on the material contacting surface of the template. This manner of marking provides the dual function of not only permitting the underlying material pattern to be viewed as it will appear assembled along the seam line, but also provides friction between the template and the material to be cut to prevent movement of the template while cutting.

A handle may be provided, secured to the template, extending from the non-contacting surface of the template.

DETAILED DESCRIPTION OF A PREFERRED EMBODIMENT

Figure 1:
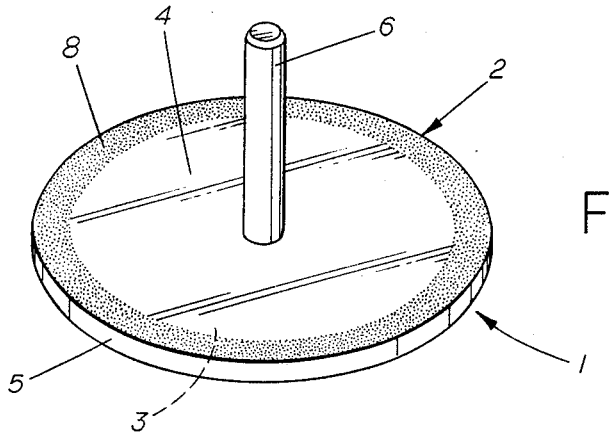
FIG. 1 is an isometric view of a particular embodiment of the present invention including its features.

FIG. 1 is an illustrative embodiment of template 1 of the present invention which includes a template body 2 having a lower, material contacting surface 3 and an upper, non-contacting surface 4, and an edge for guiding the cutting tool, i.e. guiding edge 5. The template body 2 may be formed in any desired simple or complex shape, for example the circle shown in FIG. 1, or the Dresden plate quilt pattern shapes shown in FIGS. 2 and 3. The template is formed of a material of sufficient thickness and rigidity to guide a sharp edged cutting tool without being either cut or distorted by the tool.

For safety during cutting, the template may include a handle, such as the simple stem 6 illustrated in FIG. 1, or a knob, or other suitably shaped handle.

Figure 2A:
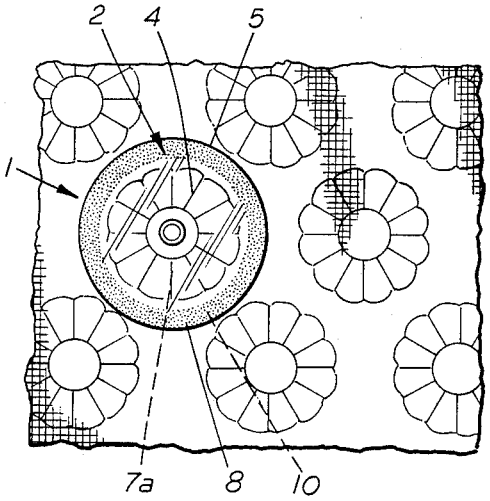
FIG. 2A shows one exemplary embodiment of the present invention placed on a fabric design to be cut, illustrating the features in use.
Figure 2B:
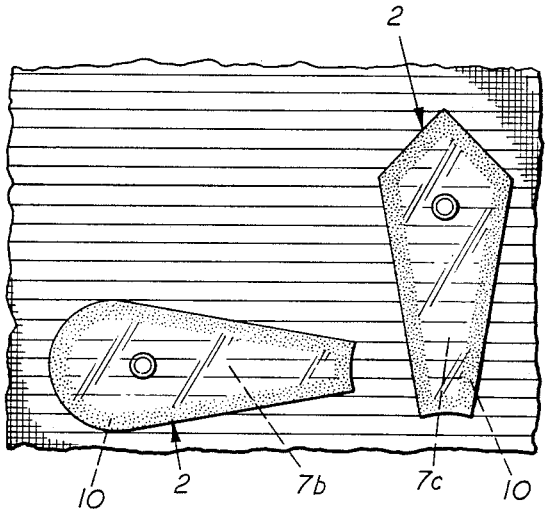
FIG. 2B illustrates the present invention in different shapes placed on another fabric design to be cut.

As illustrated in FIGS. 2A and 2B, the template is preferably made from a substantially rigid, transparent material such as transparent plastic. With the template being transparent, the design on the material to be cut, e.g. the flower shown at *7a* in FIG. 2A, and the stripes shown at *7b* and *7c* in FIG. 2B, is visible through the template so that the template can be accurately positioned to assure that the cut piece includes the desired fabric design portion for the assembled product.

Figure 3:
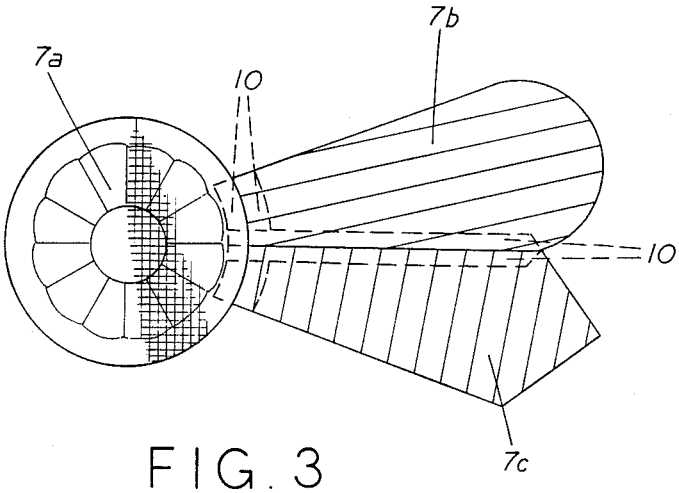
FIG. 3 shows the fabric design pieces of FIGS. 2A and 2B as they would appear after cutting and assembly.

An additional feature of the template of the present invention is the provision of a marking 8 along one of the body surfaces 3 or 4 a fixed distance from the cutting edge 5 to define a margin or seam allowance. With this marking, and a substantially transparent template body inside the marking 8, the actual finished design which will appear in the assembled product is clearly visible through the template 1. The fixed distance or margin between cut edge and seam line for seamstresses, tailors, quilters and the like is called the seam allowance. For quilting templates, the standard seam allowance is $\frac{3}{8}$ of an inch such as that shown at 10 in FIGS. 2A, 2B and 3. By providing the marking at the standard seam allowance for the particular application for which the template shape will be used, the end product as assembled will accurately conform to the design which shows through the template, as illustrated in FIG. 3.

The marking can be conveniently provided by roughening the contacting surface 3 from the cutting edge inward, stopping at the chosen seam allowance distance. With this feature, the marking provides not only the visible seam allowance feature of the invention but also provides friction between the template and the material to prevent an otherwise smooth surfaced template from sliding on the material during cutting. The handle or stem 6 additionally facilitates securing the template to the material while cutting. This rough surface portion can be roughened in any suitable manner such as chemical etching, sanding, or grinding the contacting surface 3.

The foregoing disclosure and description of the invention are illustrative and explanatory thereof, and various changes in the size, shape and materials, as well as in the details of the illustrated construction may be made without departing from the spirit of the invention the scope of which is set forth in the following claims.

What is claimed is:

1. A template for guiding a blade-type cutting tool for cutting material comprising:

a substantially rigid, substantially transparent template body having a material contacting surface and an opposite non-contacting surface and a guiding edge wherein the guiding edge corresponds to a predetermine configuration to permit the cutting tool to be abutted against the edge during the cutting process for accurately guiding the tool to cut the material in the predetermined configuration;

the material contacting surface of the body includes a rough portion to provide resistance against sliding of the template over the material so that the template remains in place during the cutting process;

said template body includes a marking which defines a margin between the cutting edge and the center of the template body which corresponds to a predetermined seam allowance; and said seam allowance marking includes said rough portion.

2. The template of claim 1 further comprising a handle extending from the non-contacting body surface.

3. A template for guiding a cutting tool for cutting material comprising:

a substantially rigid, substantially smooth, substantially transparent template body having a material contacting surface, an opposite non-contacting surface, and a guiding edge, wherein the guiding edge corresponds to a configuration conforming to a desired shape to be cut, the material contacting surface of the body includes a rough portion to provide resistance against sliding of the template over the material, and wherein the rough portion defines a margin corresponding to a predetermined seam allowance.

* * * * *